US006949972B1

(12) United States Patent
Knight

(10) Patent No.: US 6,949,972 B1
(45) Date of Patent: Sep. 27, 2005

(54) APPARATUS AND METHOD FOR CURRENT SINK CIRCUIT

(75) Inventor: Jonathan Knight, Tokyo (JP)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/817,127

(22) Filed: Apr. 2, 2004

(51) Int. Cl.[7] ..... G05F 1/10
(52) U.S. Cl. ..... 327/543
(58) Field of Search ..... 323/315, 316; 327/530, 534, 535, 537, 538, 540, 543

(56) References Cited

U.S. PATENT DOCUMENTS 5,525,927 A * 6/1996 Yung et al. ..... 327/543
6,198,343 B1 * 3/2001 Matsuoka ..... 327/543

* cited by examiner

*Primary Examiner*—Jeffrey Zweizig
(74) *Attorney, Agent, or Firm*—Darby & Darby P.C.; Matthew M. Gaffney

(57) ABSTRACT

A current sink circuit includes a current mirror, a feedback circuit, a follower circuit, and a current sink. The current mirror includes a power transistor. Also, the current mirror is ratioed such that the drain current of the power transistor is significantly greater than the drain current of the other transistor in the current mirror. The feedback circuit is configured to cause the drain voltages of the power transistor and the other transistor to be substantially equal. Additionally, the follower circuit is configured to quickly pull up the voltage at the gate of the power transistor when the current sink circuit is switched on. The current sink is configured to bias the follower circuit. Also, the current sink is configured to quickly pull down the voltage at the gate of the power transistor when the current sink circuit is switched off.

21 Claims, 6 Drawing Sheets

APPARATUS AND METHOD FOR CURRENT SINK CIRCUIT

FIELD OF THE INVENTION

The invention is related to a current sink circuit, and in particular, to an apparatus and method for a fast settling, low-dropout-voltage current sink circuit for pulse-width modulation (PWM) light-emitting diode (LED) applications.

BACKGROUND OF THE INVENTION

An LED is a useful device for many display and communication applications. Typically, an LED is a p-n junction made of a direct bandgap semiconductor. If the LED is forward-biased, positive carriers (i.e. holes) are injected into the n-side of the p-n junction, and negative carriers (i.e. electrons) are injected into the p-side of the p-n junction. The injected carriers recombine, causing photons to be released. Also, the wavelength of light provided by a forward-biased LED is a function of the bandgap voltage of the semiconductor. Generally, direct bandgap semiconductors are used for LEDs because radiative carrier recombination typically dominates in direct bandgap semiconductors, leading to light emission. Conversely, in indirect bandgap materials, most of the carrier recombination paths are nonradiative, generating heat instead of light.

According to a first approach, an LED may be driven with a DC voltage, and the DC voltage may be adjusted to adjust the brightness of the LED. According to a second approach, an LED may be driven with a high peak current having a low duty cycle, and the duty cycle of the current may be adjusted to adjust the brightness of the LED. The second approach consumes less power at a given level of brightness than the first approach.

BRIEF DESCRIPTION OF THE DRAWINGS

Non-limiting and non-exhaustive embodiments of the present invention are described with reference to the following drawings, in which.

DETAILED DESCRIPTION

Figure 1:
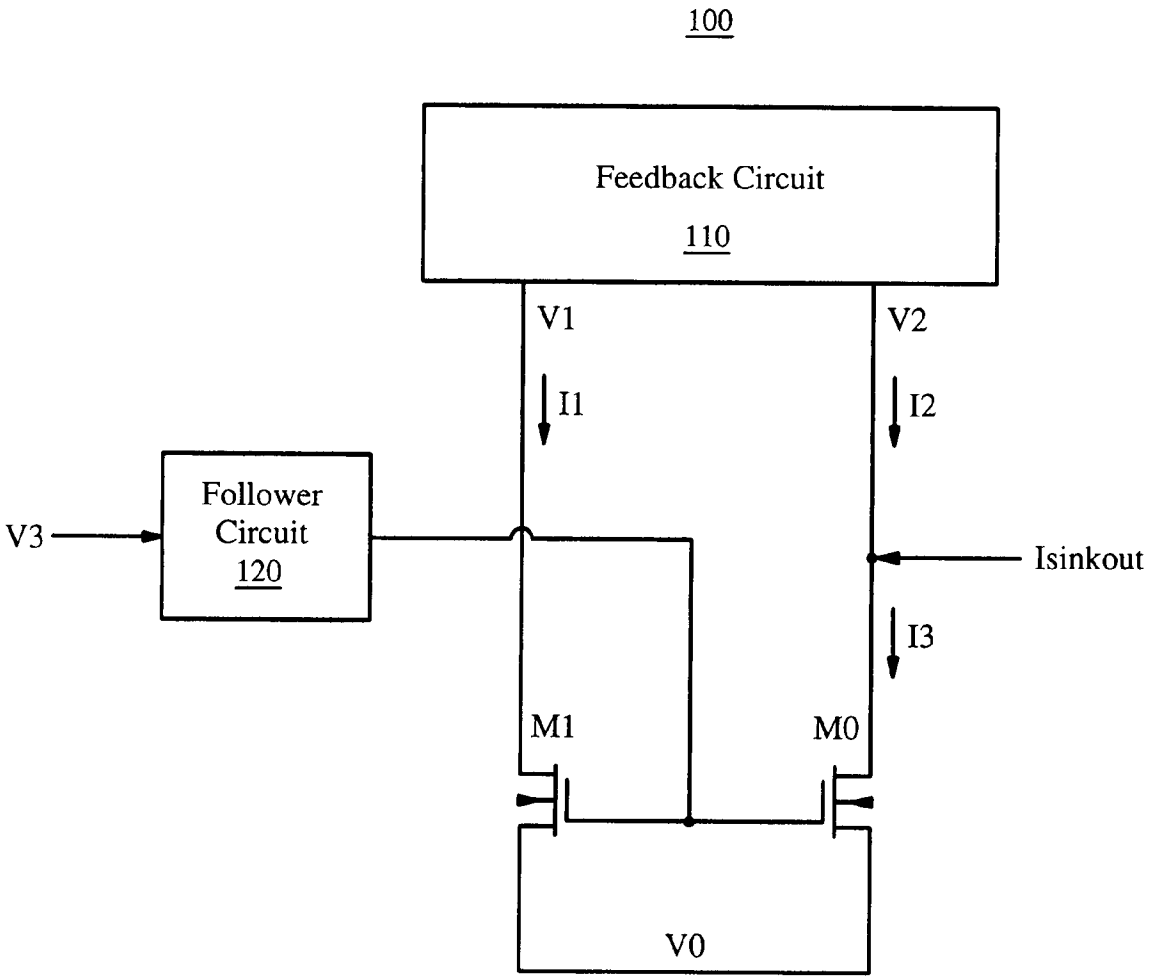
FIG. 1 illustrates a block diagram of an embodiment of a current sink circuit.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for the terms. The meaning of "a," "an," and "the" includes plural reference, and the meaning of "in" includes "in" and "on." The term "connected" means a direct electrical connection between the items connected, without any intermediate devices. The phrase "in one embodiment," as used herein does not necessarily refer to the same embodiment, although it may. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, charge, temperature, data, or other signal.

Briefly stated, the invention is related to a current sink circuit that includes a current mirror, a feedback circuit, a follower circuit, and a current sink. The current mirror includes a power transistor. Also, the current mirror is ratioed such that the drain current of the power transistor is significantly greater than the drain current of the other transistor in the current mirror. The feedback circuit is configured to cause the drain voltages of the power transistor and the other transistor to be substantially equal. Additionally, the follower circuit is configured to quickly pull up the voltage at the gate of the power transistor when the current sink circuit is switched on. The current sink is configured to bias the follower circuit. Also, the current sink is configured to quickly pull down the voltage at the gate of the power transistor when the current sink circuit is switched off.

FIG. 1 illustrates a block diagram of an embodiment of current sink circuit 100. Current sink circuit 100 includes transistors M0–M1, feedback circuit 110, and follower circuit 120.

Feedback circuit 110 is arranged to employ a feedback loop to cause voltage V1 and voltage V2 to be substantially equal. Voltage V1 may be the drain voltage of transistor M1, and voltage V2 may be the drain voltage of transistor M0. In one embodiment, feedback circuit 110 is further arranged to provide currents I1 and I2. In another embodiment, one or more other circuit elements (not shown), rather than feedback circuit 110, are configured to provide currents I1 and 12. In one embodiment, currents I1 and 12 are provided such that I1 is substantially equal to I2.

Also, transistor M0 is a power transistor. Transistors M0 and M1 are arranged in a current mirror arrangement. The current mirror has a ratio 1:R, where R is significantly greater than one. Accordingly, current I3 is significantly greater than current I1. In one embodiment, R is 1000. When the current mirror is enabled, currents I3 and I1 substantially reach equilibrium in a relatively short period of time. Additionally, current I1 may be the drain current of transistor M1, and current I3 may be the drain current of transistor M0. As may be shown from Kirchhoff's Current Law, Isinkout is substantially given by I3–I2. In an embodiment in which I1 is substantially equal to I2, Isinkout is substantially given by Isinkout=I2*(R–1).

Because voltages V1 and V2 are maintained at substantially equal voltages, the current mirror formed by transistors M0 and M1 is maintained at substantially 1:R, even if voltage V2 is relatively close to voltage V0. Accordingly, Isinkout is approximately constant, even if voltage V2 is relatively close to voltage V0. More specifically, current Isinkout is approximately constant even if V2–V0 is substantially less than the saturation voltage of transistor M0. In one embodiment, Isinkout is approximately constant even if V2–V0 is as low as approximately 150 mV.

Follower circuit 120 has an input that is coupled to voltage V3 and an output that is coupled to the gate of transistor M0. Additionally, follower circuit 120 is configured to pull the voltage at the base of transistor M0 up relatively quickly after currents I1 and I2 are provided. Consequently, current Isinkout can be provided relatively quickly after currents I1 and I2 are provided.

Accordingly, current sink circuit 100 is a relatively fast-settling, low-dropout current sink.

Figure 2:
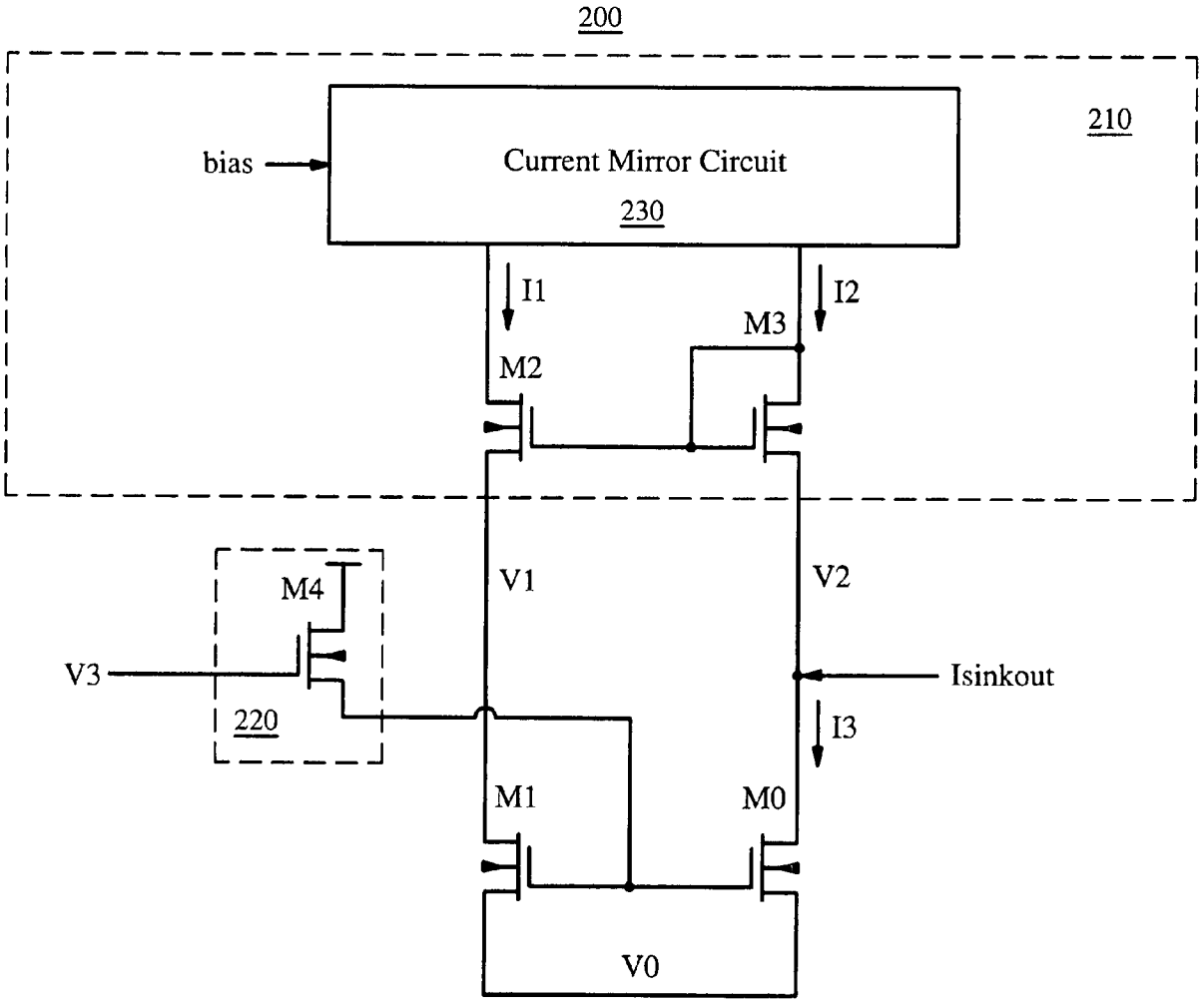
FIG. 2 shows a block diagram of an embodiment of the current sink circuit of FIG. 1.

FIG. 2 shows a block diagram of an embodiment of current sink circuit 200. Components in current sink circuit 200 may operate in a substantially similar manner as components in current sink circuit 100, and may operate in a different manner in some ways. In current sink circuit 200, feedback circuit 210 includes current mirror circuit 230 and transistors M2–M3, and follower circuit 220 includes transistor M4.

Transistor M4 is arranged as a source follower, having a gate that is coupled to voltage V3 and a source that is coupled to the gate of transistor M0.

Feedback circuit 210 is arranged such that a current feedback loop in feedback circuit 210 maintains voltages V1 and V2 at substantially equal voltages. Further, transistors M2 and M3 are arranged such that the source voltage of transistors M2 and M3 are substantially equal if the drain currents of transistors M2 and M3 are substantially equal. Current mirror circuit 230 is configured to provide currents I1 and I2 such that currents I1 and I2 are substantially equal. Also, current mirror circuit 230 is responsive to signal BIAS.

Figure 3:
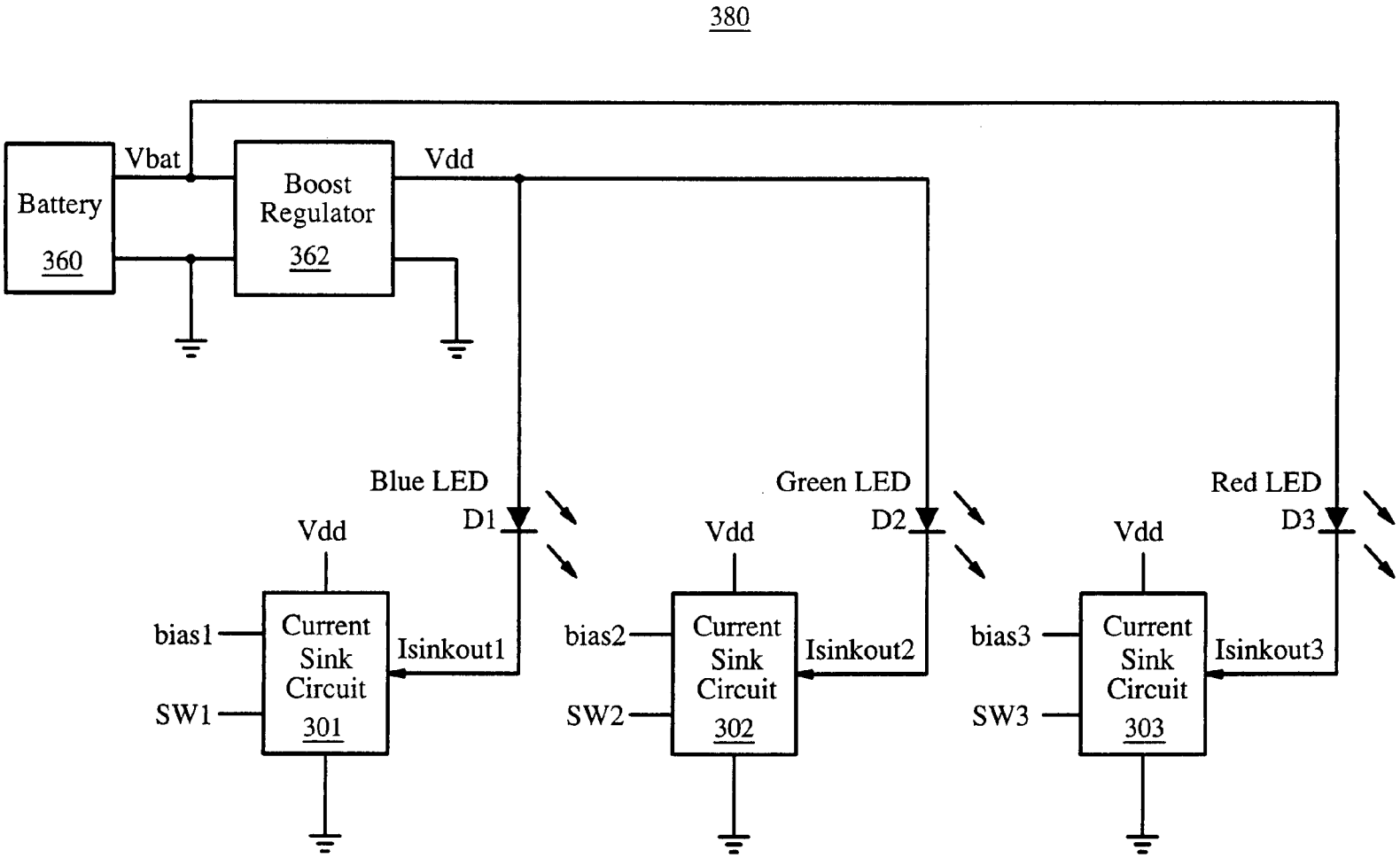
FIG. 3 illustrates an LED circuit that includes three current sink circuits.

FIG. 3 illustrates LED circuit 380. LED circuit 380 includes battery 360, boost regulator 362, blue LED D1, green LED D2, red LED D3, and current sink circuits 301–303. Currents sink circuits 301–303 may each include an embodiment of current sink circuit 100.

Battery 360 is configured to provide voltage Vbat. Further, boost regulator 362 is configured to provide voltage Vdd from voltage Vbat. In operation, each of the LEDs D1–D3 is forward-biased. Also, each of the LEDs D1–D3 may provide light as a result of the carrier recombination that occurs when the LED is forward-biased. Blue LED D1 may provide blue light, green LED D2 may provide green light, and red LED D3 may provide red light. Also, LED circuit 380 may provide white light and/or other kinds of light by appropriately combining light from two or more of the LEDs.

In one embodiment, signals SW1–SW3 are each PWM signals. The duty cycle of signals SW1–SW3 may be adjusted to control the brightness of the light provided by LEDs D1–D3 respectively. In one embodiment, signals bias1–bias3 control the peak current in current sink circuits 301–303 respectively.

LEDs D1–D3 may each have a different voltage drop across them. In one embodiment, VDD is approximately 9.5 V, the voltage drop across LED D1 is approximately 7V, the voltage drop across LED D2 is approximately 9V, and the voltage drop across LED D3 is approximately 2V.

In one embodiment, LED circuit 380 may be used for cell phone camera flash applications, as an alternative to using a flash tube. In other embodiments, LED circuit 380 may be used for other applications.

Figure 4:
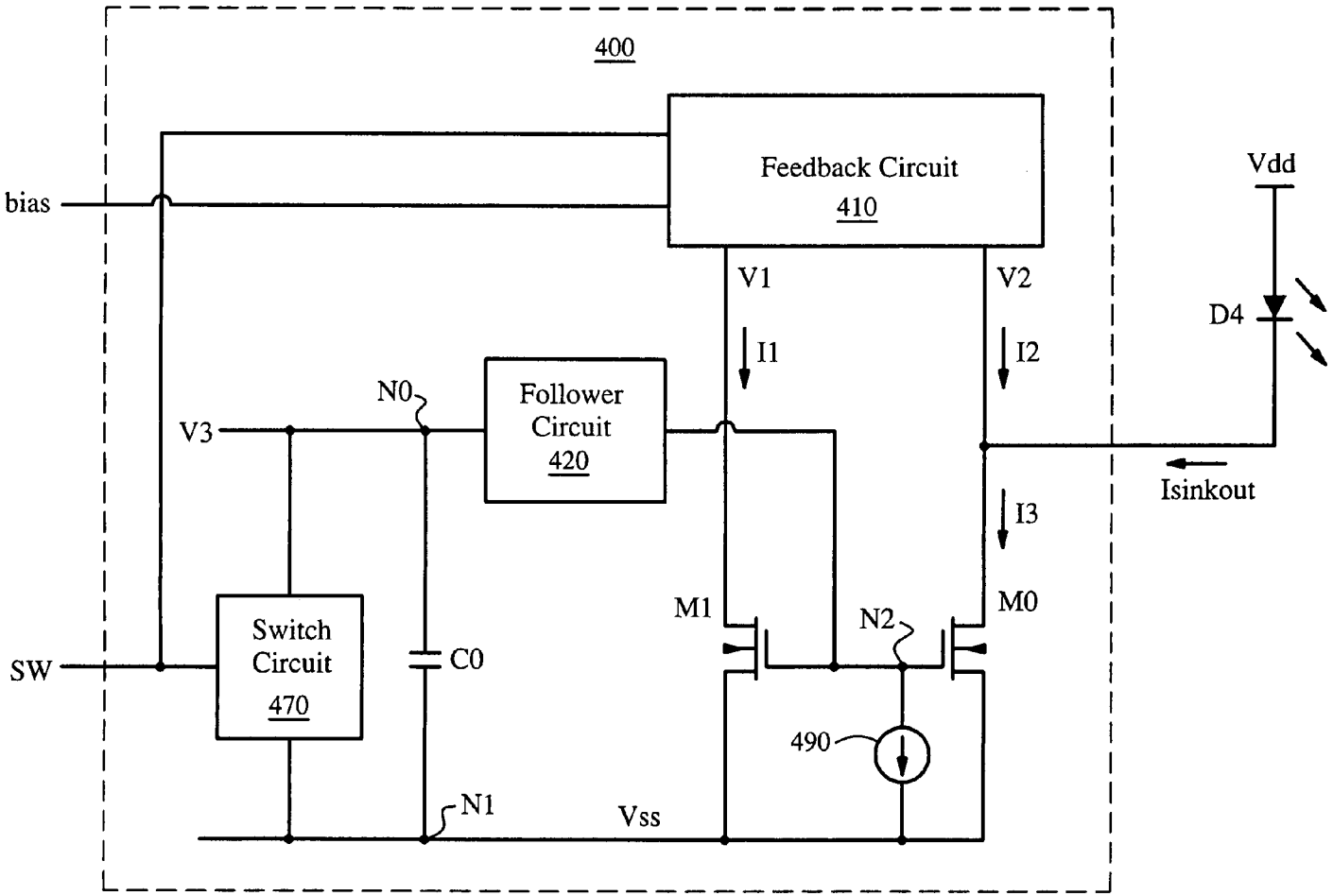
FIG. 4 shows an embodiment of one of the current sink circuits and one of the LEDs of FIG. 3.

FIG. 4 shows an embodiment of current sink circuit 400 and LED D4. Components in current sink 400 may operate in a similar manner to similarly-named components previously described, and may operate in a different manner in some ways. Current sink circuit 400 further includes switch circuit 470 and current sink 490. In one embodiment, current sink circuit 400 also includes capacitor C0.

Signal SW may be a PWM signal. In one embodiment, signal SW is arranged to operate at a frequency of about 20 kiloHertz. Feedback circuit 410 is configured to provide currents I1 and I2 if signal SW corresponds to a first logic level, and to provide substantially no current if signal SW corresponds to a second logic level. Further, switch circuit 470 is configured to close if signal SW corresponds to a second logic level, such that node N0 is coupled to node N1 if signal SW corresponds to the second logical level. Conversely, switch circuit 470 is configured to open if signal SW corresponds to the first logic level.

Accordingly, when signal SW corresponds to the second logic level, Isinkout is substantially zero. When signal SW changes to correspond to the first logic level, currents I1 and I2 are provided by feedback circuit 410 and switch circuit 470 is opened. When switch 470 opens, follower circuit 420 pulls node N2 up relatively quickly. Also, current sink 490 may bias follower circuit 420. In one embodiment, when signal SW changes to the first logic level, current sink circuit 400 reaches equilibrium in approximately 1 $\mu$s.

When signal SW changes to correspond to the second logic level, current sink 490 pulls node N2 down relatively quickly. In one embodiment, a current sink circuit 400 includes a switch (not shown) that is coupled between nodes N1 and N2, to pull down node N2 even more quickly. In this embodiment, the switch that is coupled between nodes N1 and N2 is arranged to close if signal SW corresponds to the second logic level.

Additionally, LED D4 is an LED that may be used as an embodiment of LED D1, D2, or D3 from FIG. 3. Also, voltage V2 is approximately given by VDD–$VD_{D4}$, where $V_{D4}$ is the voltage drop across LED D4. Current sink circuit 400 is arranged to provide current Isinkout at an approximately constant voltage even if $V_{D4}$ is fairly close to VDD.

Also, capacitor CO may be arranged to increase phase margin and reduce ringing.

Figure 5:
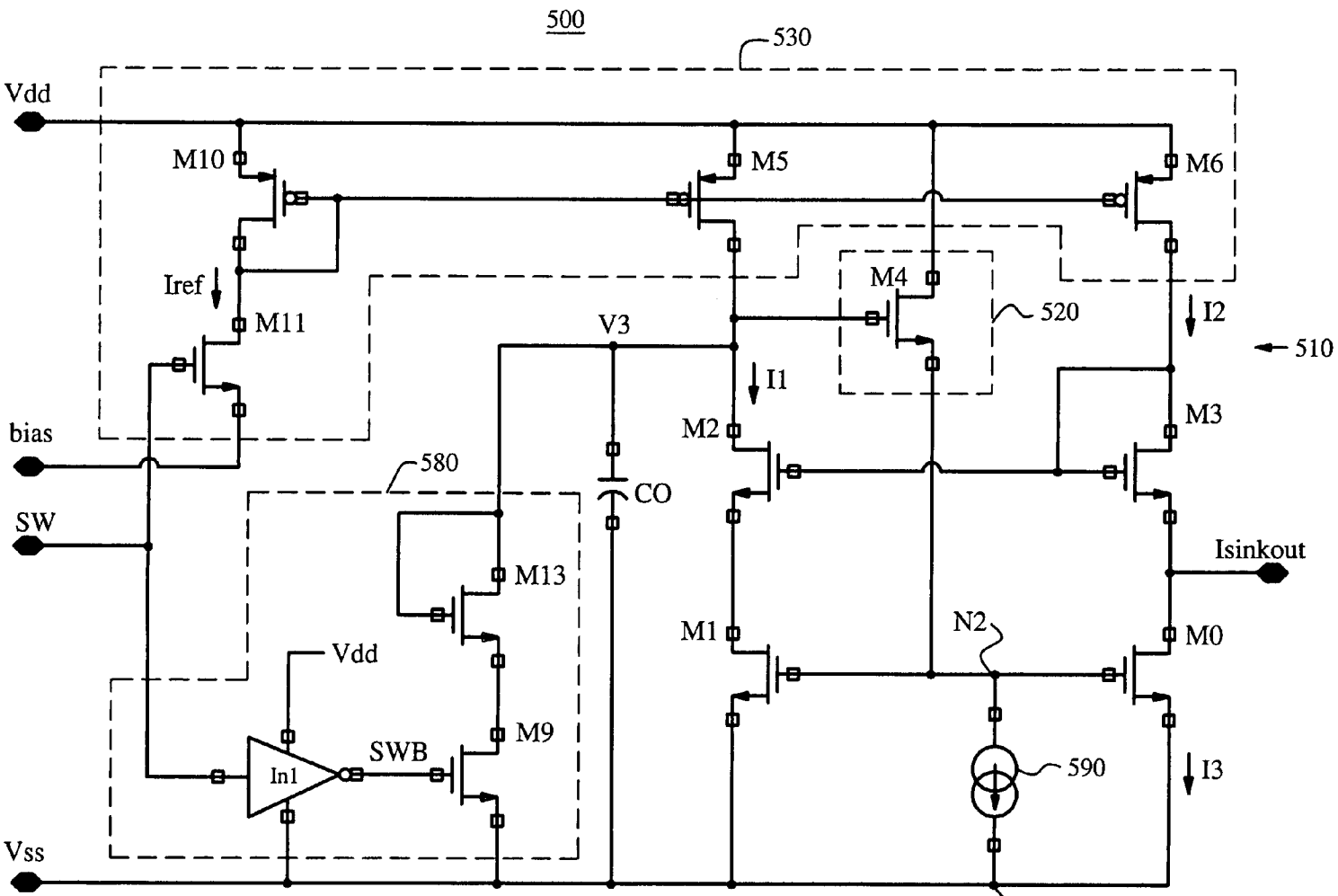
FIG. 5 schematically illustrates an embodiment of the current sink circuit of FIG. 4.

FIG. 5 schematically illustrates an embodiment of current sink circuit 500. Components in current sink 500 may operate in a similar manner to similarly-named components in current sink circuit 400, and may operate in a different manner in some ways. In current sink circuit 500, switch circuit 580 includes transistor M9, transistor M13, and inverter In1. Additionally, feedback circuit 510 includes transistors M2–M3 and current mirror circuit 530. Current mirror circuit 530 includes transistors M5, M6, M10, and M11.

Transistor M11 is arranged as a switch that is responsive to signal SW. If signal SW is high, transistor M11 provides current Iref responsive to signal BIAS. Further, current mirror circuit 530 is arranged to reflect current Iref to provide currents I1 and I2 if signal SW is high.

Also, inverter Inv1 is configured to provide signal SWB in response to signal SW. Further, transistor M9 is arranged as a switch responsive to signal SW. Transistor M13 is arranged to operate as a diode.

Additionally, transistor M4 is arranged as a source follower having a gate that is coupled to the drain of transistor M2, and also having a source that is coupled to the gate of transistor M0.

Figure 6:
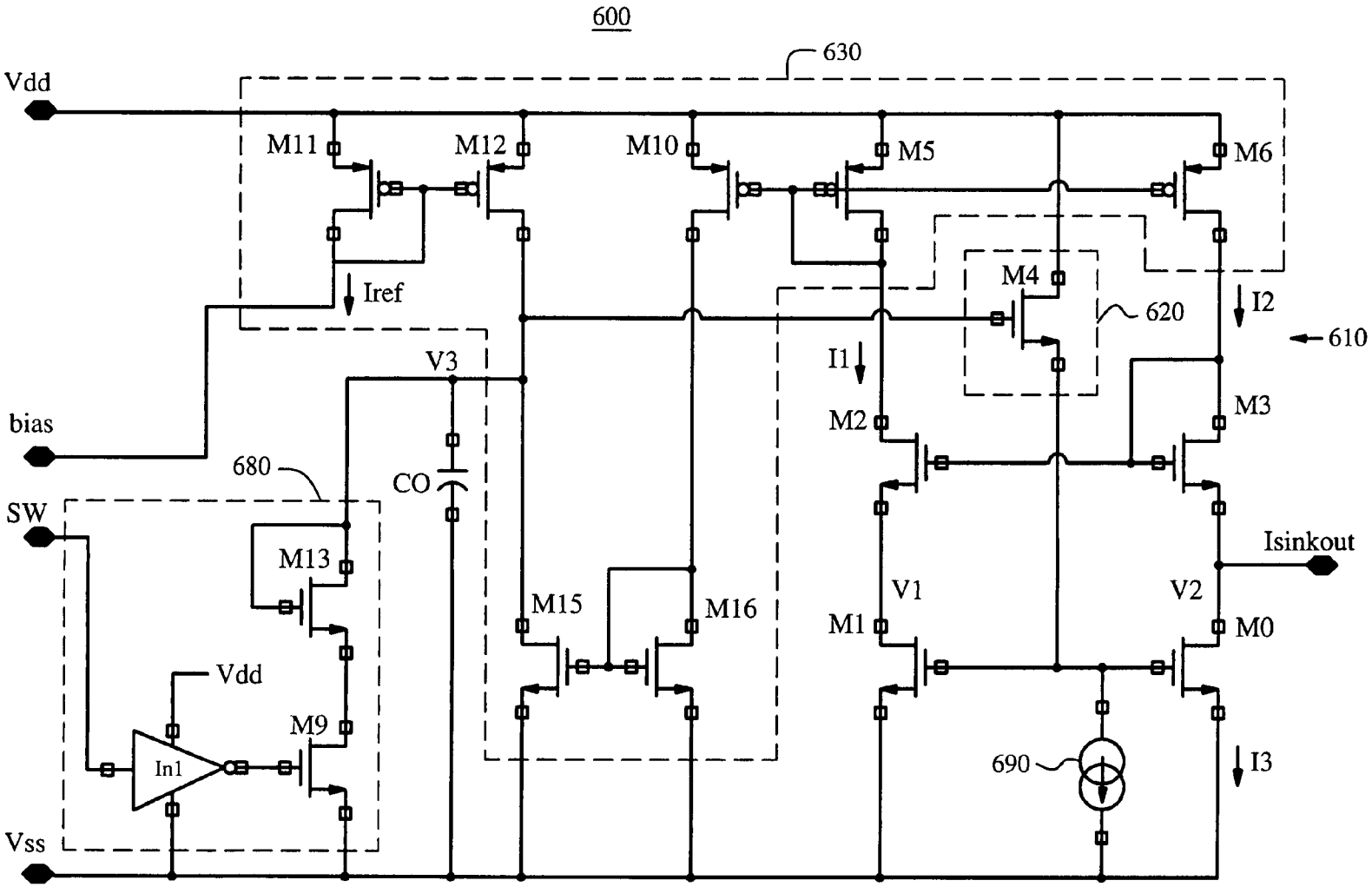
FIG. 6 schematically illustrates another embodiment of the current sink circuit of FIG. 4, arranged in accordance with aspects of the invention.

FIG. 6 schematically illustrates an embodiment of current sink circuit 600. Components in current sink circuit 600 may operate in a similar manner to similarly-named components in current sink circuit 400, and may operate in a different manner in some ways. Feedback circuit 610 includes transistors M2–M3 and current mirror circuit 630. Current mirror circuit 630 includes transistor M5–M6, M10–M12, and M15–M16.

Transistors M11 and M12 are arranged in a current mirror arrangement to reflect current Iref to provide a current at the drain of transistor M12. Also, transistors M15 and M16 are arranged in another current mirror arrangement to reflect the current at the drain of transistor M12 to the drain of transistor M16. Transistors M10, M5, and M6 are arranged in yet another current mirror arrangement to reflect the drain current of transistor M16 to provide currents I1 and I2.

In current sink circuit 600, transistor M4 is arranged as a source follower having a gate that is coupled to the drain of transistor M12. Transistor M4 is isolated from the feedback current path. Accordingly, the voltage at the drain of transistor M2 can track the voltage at the drain of transistor M3 even if voltage V2 is relatively large. This way, current sink circuit 600 is arranged to provide a relatively constant current for Isinkout even if voltage V2 is relatively large.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. A circuit for outputting a sink current, comprising:

a first current mirror that includes a power transistor and a sense transistor, wherein the power transistor is arranged such that a drain current of the power transistor is substantially greater than a drain current of the sense transistor;

a feedback circuit that is coupled to the first current mirror and arranged such that a drain voltage for the sense transistor is relatively equivalent to a drain voltage for the power transistor;

a follower circuit that is coupled to the first current mirror and arranged such that an output terminal of the follower circuit is coupled to a gate of the power transistor and a gate of the sense transistor, wherein the follower circuit enables the drain current of the power transistor and the drain current of the sense transistor to substantially reach equilibrium in a relatively short period of time if an input signal is asserted; and a current sinking circuit that is arranged such that the outputted sink current is substantially turned off in a relatively short period of time if the input signal is de-asserted, wherein the current sinking current is coupled to the gate of the power transistor and the gate of the sense transistor.

2. The circuit of claim 1, wherein the follower circuit enables the outputted sink current to reach a peak value in a relatively short period of time.

3. The circuit of claim 1, wherein the input signal includes a pulse width modulation signal.

4. The circuit of claim 3, wherein the pulse width modulation signal operates at a frequency of at least 20 kiloHertz.

5. The circuit of claim 1, wherein the current sinking circuit includes at least one of a switch and a current sink.

6. The circuit of claim 1, further comprising a capacitive element that is arranged such that an operation of the capacitive element enables ringing to be substantially reduced.

7. The circuit of claim 6, wherein the capacitive element is coupled between an input terminal for the follower circuit and a VSS power supply node, wherein an operation of the capacitive element enables ringing to be sustatially reduced.

8. The circuit of claim 1, wherein the feedback circuit includes a second current mirror, and a first transistor and a second transistor that are coupled to the first current mirror, wherein a gate of the first transistor is coupled to a gate of the second transistor.

9. The circuit of claim 8, wherein an input terminal of the follower circuit is coupled to a drain of the first transistor.

10. The circuit of claim 8, wherein the feedback circuit includes a third current mirror and a fourth current mirror, wherein the fourth current mirror is arranged to provide a reflected current at a node in response to a reference current, and the third current mirror is arranged to provide another reflected current to the second current mirror in response to the reflected current.

11. The circuit of claim 10, wherein an input terminal for the follower circuit is coupled to the node.

12. The circuit of claim 1, wherein the follower circuit includes a source follower.

13. The circuit of claim 1, wherein the outputted sink current is provided at a drain of the power transistor.

14. The circuit of claim 1, wherein the outputted sink current is provided at a cathode of a light emitting diode (LED).

15. A circuit for outputting a sink current at a cathode of a light emitting diode (LED), comprising:

a first current mirror that includes a power transistor and another transistor, wherein the power transistor is arranged such that a drain current of the power transistor is substantially greater than a drain current of the other transistor;

a feedback circuit that is coupled to the first current mirror and arranged such that a drain voltage for the other transistor is relatively equivalent to a drain voltage for the power transistor, wherein the feedback circuit includes a second current mirror, and a first transistor and a second transistor that are coupled to the first current mirror, and wherein a gate of the first transistor is coupled to a gate of the second transistor;

a follower circuit that is coupled to the first current mirror and arranged such that an output terminal of the follower circuit is coupled to a gate of the power transistor and a gate of the other transistor, wherein the follower circuit enables the drain current of the power transistor and the drain current of the other transistor to substantially reach equilibrium in a relatively short period of time if a pulse width modulation input signal is asserted; and a current sinking circuit that is arranged such that the outputted sink current is substantially turned off in a relatively short period of time if the pulse width modulation input signal is de-asserted, wherein the current sinking current is coupled to the gate of the power transistor and the gate of the other transistor.

16. The circuit of claim 15, wherein the current sinking circuit includes at least one of a switch and a current sink.

17. The circuit of claim 15, further comprising a capacitive element that is arranged between an input terminal for the follower circuit and a VSS power supply node, wherein an operation of the capacitive element enables ringing to be substantially reduced.

18. The circuit of claim 15, wherein an input terminal of the follower circuit is coupled to a drain of the first transistor.

19. The circuit of claim 15, wherein the feedback circuit includes a third current mirror and a fourth current mirror, wherein the fourth current mirror is arranged to provide a reflected current at a node in response to a reference current, and the third current mirror is arranged to provide another reflected current to the second current mirror in response to the reflected current, and wherein an input terminal for the follower circuit is coupled to the node.

20. The circuit of claim 15, wherein the follower circuit includes a source follower.

21. A circuit for outputting a sink current, comprising:

a means for mirroring current that includes a power transistor and another transistor, wherein the power transistor is arranged such that a drain current of the power transistor is substantially greater than a drain current of the other transistor;

a means for providing feedback such that a drain voltage for the other transistor is relatively equivalent to a drain voltage for the power transistor;

a means for following a voltage such that the drain current of the power transistor and the drain current of the other transistor to substantially reach equilibrium in a relatively short period of time if an input signal is asserted; and a means for sinking current such that the outputted sink current is substantially turned off in a relatively short period of time if the input signal is de-asserted, wherein the current sinking current is coupled to the gate of the power transistor and the gate of the other transistor.

* * * * *

UNITED STATES PATENT AND TRADEMARK OFFICE

CERTIFICATE OF CORRECTION

PATENT NO. : 6,949,972 B1
DATED : September 27, 2005
INVENTOR(S) : Jonathan R. Knight It is certified that error appears in the above-identified patent and that said Letters Patent is hereby corrected as shown below:

Column 6,
Line 2, delete "sustatially" and insert -- substantially --.

Signed and Sealed this

Thirteenth Day of December, 2005

JON W. DUDAS
*Director of the United States Patent and Trademark Office*